US011448105B2

(12) United States Patent
Liu et al.

(10) Patent No.: US 11,448,105 B2
(45) Date of Patent: Sep. 20, 2022

(54) VALVE MECHANISM, ENGINE AND VEHICLE

(71) Applicant: GREAT WALL MOTOR COMPANY LIMITED, Hebei (CN)

(72) Inventors: Tao Liu, Baoding (CN); Ji Yin, Baoding (CN); Luping Liu, Baoding (CN); Liming Xu, Baoding (CN); Jiajia Hu, Baoding (CN); Fabao Yang, Baoding (CN); Song Zhang, Baoding (CN); Yanlong Fang, Baoding (CN); Lei Wang, Baoding (CN)

(73) Assignee: GREAT WALL MOTOR COMPANY LIMITED, Baoding (CN)

( * ) Notice: Subject to any disclaimer, the term of this patent is extended or adjusted under 35 U.S.C. 154(b) by 343 days.

(21) Appl. No.: 16/620,603

(22) PCT Filed: Jun. 7, 2018

(86) PCT No.: PCT/CN2018/090301

§ 371 (c)(1),
(2) Date: Dec. 9, 2019

(87) PCT Pub. No.: WO2018/224017

PCT Pub. Date: Dec. 13, 2018

(65) Prior Publication Data

US 2020/0141291 A1 May 7, 2020

(30) Foreign Application Priority Data

Jun. 9, 2017 (CN) ..... 201720676079.9

(51) Int. Cl.
*F01L 31/12* (2006.01)
*F01L 1/22* (2006.01)
*F01L 1/46* (2006.01)

(52) U.S. Cl.
CPC ..... *F01L 31/12* (2013.01); *F01L 1/22* (2013.01); *F01L 1/46* (2013.01); *F01L 2710/00* (2013.01)

(58) Field of Classification Search
CPC ..... F01L 1/22; F01L 1/46; F01L 1/053; F01L 1/185; F01L 1/18; F01L 1/047;
(Continued)

(56) References Cited

U.S. PATENT DOCUMENTS

2006/0027194 A1* 2/2006 Battlogg ..... F01L 1/30 123/90.16
2007/0227479 A1* 10/2007 Fuwa ..... F01L 1/34 123/90.16

(Continued)

FOREIGN PATENT DOCUMENTS

CN 205400840 U 7/2016
CN 205422859 U * 8/2016 ..... F01L 13/0063

(Continued)

OTHER PUBLICATIONS

The Extended European Search Report dated Feb. 25, 2021, including the Supplementary European Search Report and the European Search Opinion, in connection with corresponding EP Application No. 18812869.8 (8 pp.).

(Continued)

*Primary Examiner* — Devon C Kramer
*Assistant Examiner* — Kelsey L Stanek
(74) *Attorney, Agent, or Firm* — Maier & Maier, PLLC

(57) ABSTRACT

A valve mechanism includes a valve, a camshaft, an intermediate swing arm located between a cam and the valve, a lift regulating mechanism and a roller assembly. The cam drives the valve to move by means of the intermediate swing arm. The roller assembly is supported by the cam, an eccentric wheel of the lift regulating mechanism and an intermediate swing arm roller. A peripheral surface of the eccentric wheel includes a lift regulating section having a start point and an end point, a maximum lift point of the lift regulating section is located between the start point and the end point, and the lift regulating section is divided into a first section which is convex and a second section having at least a part thereof concave.

12 Claims, 2 Drawing Sheets

(58) Field of Classification Search
CPC . F01L 1/2405; F01L 1/34; F01L 31/12; F01L 2710/00; F01L 2001/0537; F01L 2001/0476; F01L 2001/467; F01L 2013/0068; F01L 2013/0063; F01L 2013/103; F01L 2800/12; F01L 2820/041; F01L 2305/00
USPC ..... 123/90.12
See application file for complete search history.

(56) References Cited

U.S. PATENT DOCUMENTS

2007/0266971 A1* 11/2007 Bosl-Flierl ..... F01L 13/0063 123/90.16
2008/0302320 A1* 12/2008 Tateno ..... F01L 13/0021 123/90.16
2011/0197838 A1* 8/2011 Yamaguchi ..... F01L 13/0026 123/90.16

FOREIGN PATENT DOCUMENTS

| | | | | |
|---|---|---|---|---|
| CN | 205422859 | U | 8/2016 | |
| CN | 206889031 | U | 1/2018 | |
| CN | 206889047 | U | 1/2018 | |
| CN | 206889048 | U | 1/2018 | |
| DE | 10 2012 006 983 | A1 | 10/2013 | |
| DE | 102017204920 | A1 * | 9/2018 | ..... F04B 1/0408 |
| WO | 2005/093225 | A1 | 10/2005 | |

OTHER PUBLICATIONS

International Search Report dated Aug. 9, 2018 in corresponding International application No. PCT/CN2018/090301; 6 pages.

* cited by examiner

VALVE MECHANISM, ENGINE AND VEHICLE

CROSS-REFERENCE TO RELATED APPLICATION

The present application claims priority to Chinese Patent Application Serial No. 201720676079.9, entitled "Valve Mechanism. Engine and Vehicle", filed by the Great Wall Motor Company Limited on Jun. 9, 2017.

FIELD

The present application relates to a field of automobiles, and particularly to a valve mechanism, an engine and a vehicle.

BACKGROUND

For a valve mechanism in the related art, an eccentric wheel thereof is adapted to come into contact with a roller assembly which in turn is mounted on an intermediate swing arm. Thus, when the eccentric wheel rotates, a contact position between the intermediate swing arm and a valve roller may be changed, thereby changing a lift of a valve. When failures occur in an electronic control component and in a certain phase of a three phase line of an electric motor for a continuously variable valve lift system (i.e., a CVVL system) of an engine, the lift changing function of the CVVL system is disabled, and the position of the traditional eccentric wheel will not be controlled actively. If the eccentric wheel is not located in the vicinity of a maximum lift, the eccentric wheel may rotate automatically towards a small lift under the action of a received resultant force. If the eccentric wheel stays at the small lift position, cold start of the engine could not be performed, causing inconvenience to a user.

SUMMARY

In view of this, the present application is intended to propose a valve mechanism to self lock an eccentric wheel at a maximum lift point.

To achieve the above-mentioned objective, the present application provides the technical solution as follows.

A valve mechanism includes a valve having a valve roller; a camshaft provided with a cam; an intermediate swing arm located between the cam and the valve, and the cam being configured to drive the valve to move by means of the intermediate swing arm, and the intermediate swing arm having an intermediate swing arm roller, and a lift regulating mechanism and a roller assembly, the lift regulating mechanism including an eccentric wheel, the roller assembly being supported by the cam, the eccentric wheel and the intermediate swing arm roller, the lift regulating mechanism being configured to variably regulate a lift of the valve continuously. The peripheral surface of the eccentric wheel includes a lift regulating section having a start point and an end point, a maximum lift point of the lift regulating section is located between the start point and the end point, the lift regulating section is divided into a first section from the start point to the maximum lift point and a second section from the maximum lift point to the end point, the first section is configured as a convex arc, at least a part of the second section is configured as an oblique line section and/or a concave arc, and a distance between any point on the at least a part of the second section and a rotation axis of the eccentric wheel is less than a distance between the maximum lift point and the rotation axis of the eccentric wheel.

According to some embodiments of the present application, the concave second section has a wrap angle of 8 to 15 degrees.

Further, the concave second section has the wrap angle of 9 to 12 degrees.

According to some embodiments of the present application, the lift regulating section has a wrap angle of 180 to 220 degrees.

According to some embodiments of the present application, the second section has a difference value between a maximum radius of curvature and a minimum radius of curvature of 0.5 to 2 mm.

Furthermore, the second section has the difference value between the maximum radius of curvature and the minimum radius of curvature of 0.8 to 1.3 mm.

Optionally, the second section has a radius of curvature ranging from 24 to 30 mm.

According to some embodiments of the present application, the roller assembly includes a spindle; an outer ring, the outer ring being fitted over the spindle, and a plurality of needle rollers surrounding the spindle being provided between the outer ring and the spindle and enabling the outer ring to rotate relative to the spindle; and axial limiting portions located at two axial ends of the outer ring respectively to limit the outer ring axially, and outer diameters of the axial limiting portions being less than an outer diameter of the outer ring, such that the outer ring protrudes out of peripheral surfaces of the axial limiting portions in a radial direction of the spindle, and portions of two axial end surfaces of the outer ring exposed out of the axial limiting portions are configured as axial thrust surfaces.

Further, each roller assembly corresponds to two eccentric wheels, the two eccentric wheels define a groove therebetween, the outer ring is clamped in the groove, and the axial limiting portions are in sliding fit with the eccentric wheels.

Optionally, an average radius of curvature of the second section is 1.5 to 2.5 times a radius of the axial limiting portion.

Compared with the related art, the valve mechanism according to the present application has the advantages as follows.

With the valve mechanism according to the present application, when a CVVL system fails to work normally, an engine may be triggered into a limp mode. At this point, running of the roller assembly does not exert a torsional force on the eccentric wheel, the eccentric wheel is locked, and the engine is self locked at a maximum lift position; thus, the engine may still be started, such that a user may be facilitated to drive a vehicle to a maintenance station for maintenance.

A second objective of the present application is to propose an engine including the above-mentioned valve mechanism.

A third objective of the present application is to propose a vehicle including the above-mentioned engine.

The advantages of the engine and the vehicle are the same as the advantages of the above-mentioned valve mechanism compared with the related art, which will not be repeated herein.

BRIEF DESCRIPTION OF THE DRAWINGS

The accompanying drawings which constitute a part of the present application serve to provide a further understanding of the present application, and exemplary embodiments of the present application and explanation thereof are used for interpreting the present application, without limiting the present application improperly. In the drawings.

Figure 1:
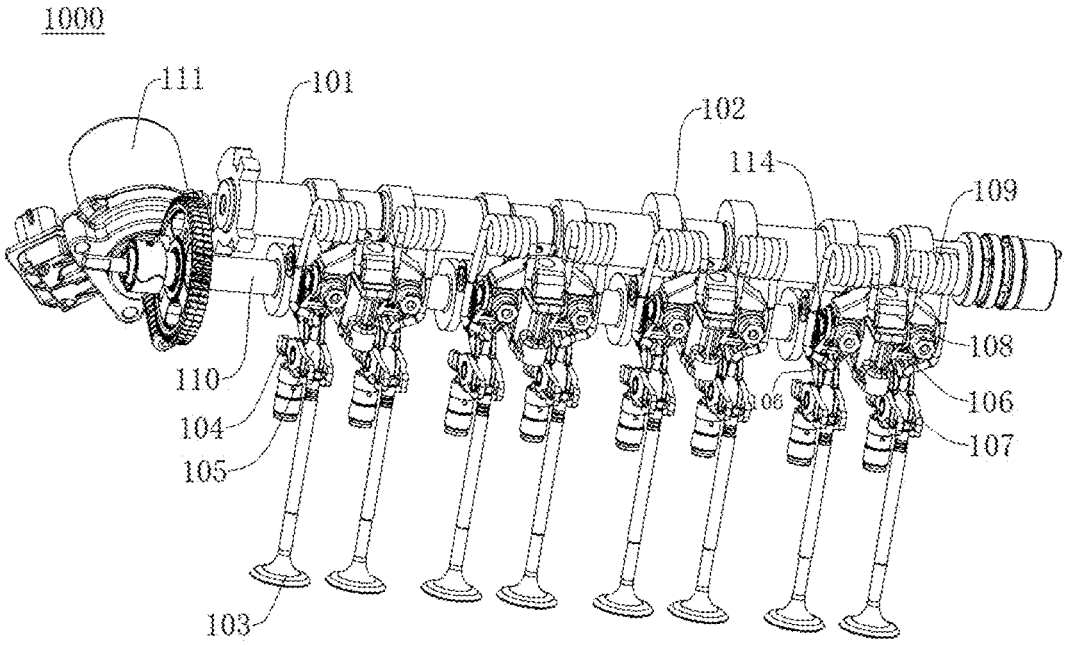
FIG. 1 is a schematic overall diagram of a valve mechanism according to an embodiment of the present application.

REFERENCE NUMERALS valve mechanism 1000; camshaft 101; cam 102; valve 103; valve rocker 104; valve roller 105; intermediate swing arm 106; supporting base 107; fixed support 108; elastic restoring device 109; lift regulating shaft 110; drive electric motor 111; roller assembly 112; eccentric wheel 113; lift regulating section 1131; intermediate swing arm shaft 114; intermediate swing arm roller 115; first section 116; second section 117;

spindle 501; outer ring 502; axial limiting portion 503; needle roller 504; axial thrust surface 505.

DETAILED DESCRIPTION

It should be noted that the embodiments in the present application and features therein may be combined mutually in the case of no conflicts.

A valve mechanism 1000 according to the present application will be described in detail below with reference to FIGS. 1 to 5 in conjunction with the embodiments.

As shown in FIG. 1, the valve mechanism 1000 according to the embodiment of the present application may include a valve 103, a camshaft 101, an intermediate swing arm 106, a lift regulating mechanism and a roller assembly 112. The valve mechanism 1000 may be configured to control an inlet valve 103 to be opened and closed.

The valve 103 has a valve roller 105. Specifically, a valve rocker 104 is provided at a top of the valve 103, and the valve roller 105 is rotatably provided to the valve rocker 104. The valve 103 may move up and down along a center line of the valve 103 to open or close an air inlet in a cylinder head.

The camshaft 101 is provided with a cam 102, the intermediate swing arm 106 is located between the cam 102 and the valve 103, and the cam 102 drives the valve 103 to move by means of the intermediate swing arm 106. Specifically, a drive profile is formed at a bottom of the intermediate swing arm 106 and attached to the valve roller 105. Further, an intermediate swing arm roller 115 is provided in a middle of the intermediate swing arm 106, and an intermediate swing arm shaft 114 passes through the top of the intermediate swing arm 106, is fixed into a fixed support 108, and may be in interference fit with the fixed support 108 or regulated back and forth relative to the fixed support 108 (in a direction perpendicular to the camshaft 101).

The lift regulating mechanism may include an eccentric wheel 113, and the roller assembly 112 is supported by the cam 102, the eccentric wheel 113 and the intermediate swing arm roller 115. A supporting base 107 is fixed on the cylinder head, and the fixed support 108 is fixed on the supporting base 107 and also configured to fix an elastic restoring device 109, which is configured to supply an elastic restoring force to the intermediate swing arm 106, such that the cam 102, the eccentric wheel 113 and the intermediate swing arm roller 115 are attached and in contact all the time.

The lift regulating mechanism is configured to variably regulate a lift of the valve 103 continuously. Specifically, the lift regulating mechanism regulates the lift of the valve by regulating a contact position between the drive profile at the bottom of the intermediate swing arm 106 and the valve roller 105.

When the valve mechanism 1000 works, the cam 102 rotates with the camshaft 101 and drives periodically the intermediate swing arm 106 to swing around the intermediate swing arm shaft 114, and the drive profile at the bottom of the intermediate swing arm 106 drives the valve roller 105 to enable the valve 103 to move downwards along the center line of the valve, thereby opening the air inlet in the cylinder head to realize air admission. The valve 103 may be restored through a valve spring, and the intermediate swing arm 106 may be restored through the elastic restoring device 109.

When the lift of the valve is required to be regulated, a drive electric motor 111 drives a lift regulating shaft 110 to rotate clockwise or anticlockwise. Thus, the lift regulating shaft 110 drives the eccentric wheel 113 to rotate. Since the eccentric wheel 113 is eccentric relative to the lift regulating shaft 110, the eccentric wheel 113 drives the intermediate swing arm 106, through the roller assembly 112, to swing at a small angle around an axis of the intermediate swing arm shaft 114, thereby changing the contact position between the drive profile of the intermediate swing arm 106 and the valve roller 105, and then variably regulating the lift of the valve continuously.

Figure 3:
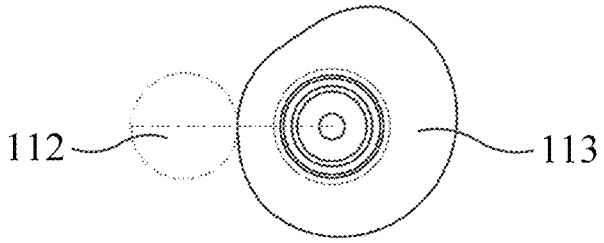
FIG. 3 is a schematic diagram of a position of an eccentric wheel at a small lift.
Figure 4:
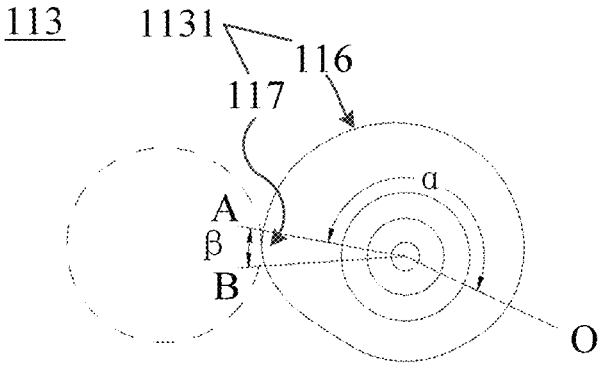
FIG. 4 is a schematic diagram of the position of an eccentric wheel at a large lift.
Figure 5:
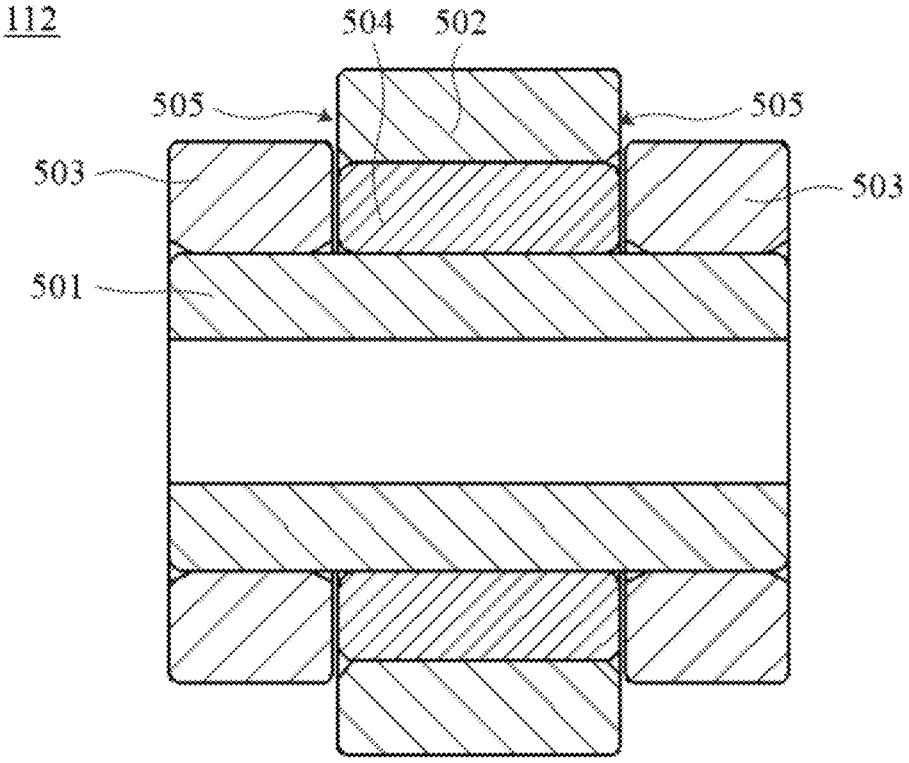
FIG. 5 is a schematic diagram of a roller assembly.

As shown in FIGS. 3 to 4, a peripheral surface of the eccentric wheel 113 may include a lift regulating section 1131 (i.e., section OB), the lift regulating section 1131 includes a start point O and an end point B with a maximum lift point A of the lift regulating section 1131 located between the start point O and the end point B, the lift regulating section 1131 is divided into a first section 116 from the start point O to the maximum lift point A and a second section 117 from the maximum lift point A to the end point B, and the first section 116 is configured as a convex arc.

In some optional embodiments, at least a part of the second section 117 is configured as a concave arc. In some other optional embodiments, at least a part of the second section 117 is configured as an oblique line section. Further optionally, at least a part of the second section 117 has a line type combining the oblique line section and the concave arc.

Further, a distance between any point on at least a part of the second section 117 and a rotation axis of the eccentric wheel 113 is less than a distance between the maximum lift point A and the rotation axis of the eccentric wheel 113.

As shown in FIG. 4, in the specific embodiment, the first section 116 and the second section 117 may have variable radii of curvature. For example, the radius of curvature of the first section 116 is increased gradually from the point O, and the lift of the valve is gradually increased correspondingly and reaches a maximum value at the point A. However, the radius of curvature of the second section 117 (section AB) is reduced gradually.

From FIG. 4, when the valve 103 reaches the maximum lift, the eccentric wheel 113 is self locked and in this case the eccentric wheel 113 does not rotate automatically when the camshaft 101 drives the valve 103. The principle is as follows. When the eccentric wheel 113 is located at a maximum lift position (the position shown in FIG. 4), the roller assembly 112 moves on a cambered surface of the eccentric wheel 113, and a radius of a movement track of the roller assembly 112 is less than a radius of the eccentric wheel 113 at the maximum lift point A. That is, when the eccentric wheel 113 is located at the maximum lift position, a range of the movement track of the roller assembly 112 is an area where a pressure angle is greater than a frictional angle of a profile of the eccentric wheel 113, and the eccentric wheel 113 is subjected to a resultant force having a direction passing through a center of the eccentric wheel 113. At this point, running of the roller assembly 112 does not exert a torsional force on the eccentric wheel 113, and the eccentric wheel 113 may be fixed at the maximum lift position, thereby achieving locking of the eccentric wheel 113.

In the case of a failure of a CVVL system of an engine, the engine of a vehicle will be triggered into a limp mode. An electric motor will regulate a position of the lift regulating shaft 110, so as to locate a contact point between the roller assembly 112 and the eccentric wheel 113 at the maximum lift point A. At this point, the eccentric wheel 113 is fixed at the maximum lift point A due to self locking action, and then a load may be controlled with a throttle valve, such that a customer may drive to a maintenance station for maintenance, avoiding the vehicle failing to travel since the engine is unable to be started.

With the valve mechanism 1000 according to the embodiments of the present application, when the CVVL system fails to work normally, the engine may be triggered into the limp mode. At this point, running of the roller assembly 112 does not exert a torsional force on the eccentric wheel 113, the eccentric wheel 113 is locked, and the engine is self locked at the maximum lift position; thus, the engine may still be started, such that the user may be facilitated to drive the vehicle to the maintenance station for maintenance.

In some embodiments of the present application, the concave second section 117 has a wrap angle $\beta$ of 8 to 15 degrees. Further, the concave second section 117 has the wrap angle $\beta$ of 9 to 12 degrees.

In some embodiments of the present application, the lift regulating section 1131 has a wrap angle ($\alpha+\beta$) of 180 to 220 degrees, in which a represent a wrap angle of the first section 116.

In some embodiments of the present application, the second section 117 has a difference value between a maximum radius of curvature and a minimum radius of curvature of 0.5 to 2 mm.

Furthermore, the second section 117 has the difference value between the maximum radius of curvature and the minimum radius of curvature of 0.8 to 1.3 mm. Optionally, the second section 117 has a radius of curvature ranging from 24 to 30 mm.

In the specific embodiments, the roller assembly 112 may include a spindle 501, an outer ring 502 and an axial limiting portion 503.

The outer ring 502 is fitted over the spindle 501, and a plurality of needle rollers 504 surrounding the spindle 501 are provided between the outer ring 502 and the spindle 501, and enable the outer ring 502 to rotate relative to the spindle 501. Specifically, the outer ring 502 and the needle roller 504 may move in circles around a central axis of the spindle 501, and by providing the needle roller 504, the outer ring 502 rotates more stably and smoothly relative to the spindle 501.

The axial limiting portion 503 is fitted over the spindle 501 and fixed to the spindle 501. Further, the axial limiting portions 503 are located at two axial ends of the outer ring 502 respectively, so as to limit the outer ring 502 axially. Specifically, referring to FIG. 5, the left axial limiting portion 503 is provided at a left side of the outer ring 502, the right axial limiting portion 503 is provided at a right side of the outer ring 502, and the outer ring 502 is clamped between the two axial limiting portions 503.

Further, outer diameters of the axial limiting portions 503 are less than an outer diameter of the outer ring 502, such that the outer ring 502 protrudes out of the peripheral surfaces of the axial limiting portions 503 in a radial direction of the spindle 501, and portions of two axial end surfaces of the outer ring 502 exposed out of the axial limiting portions 503 are configured as axial thrust surfaces 505.

Further, each roller assembly 112 corresponds to two eccentric wheels 113, the two eccentric wheels 113 define a groove therebetween, and the outer ring 502 is clamped in the groove of each group of eccentric wheels 113. Thus, the roller assembly 112 is positioned axially, and the axial limiting portions 503 are in sliding fit with the eccentric wheels 113. The axial thrust surfaces 505 may be located between the two corresponding eccentric wheels 113 in FIG. 2, and clamped and positioned by the two eccentric wheels 113, and may perform axial thrusting to prevent an axial play of the roller assembly 112, thereby preventing the roller assembly 112 from flying off. Meanwhile, the axial limiting portions 503 may come into contact with the eccentric wheels 113, and the outer ring 502 comes into contact with the intermediate swing arm roller 115 and the cam 102 separately.

Figure 2:
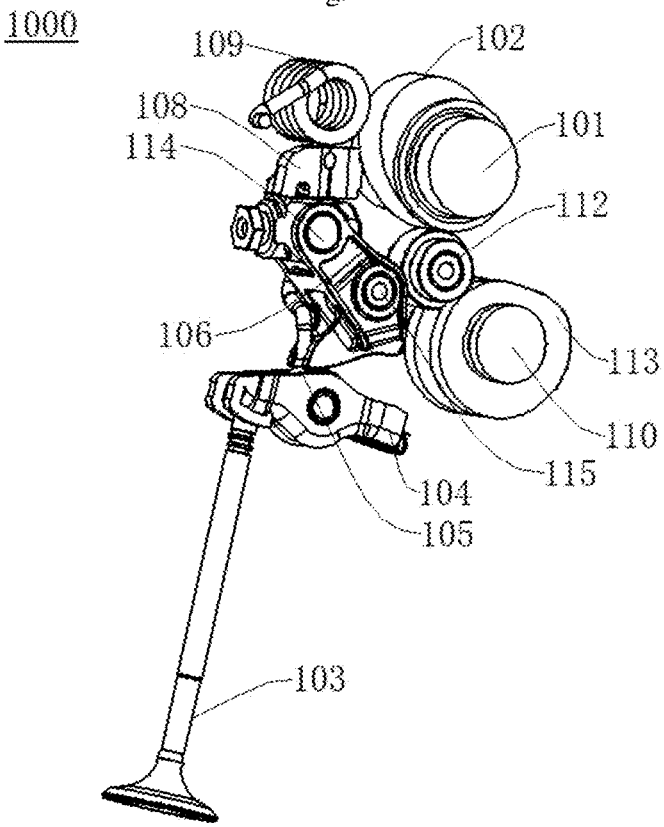
FIG. 2 is a schematic diagram of principles of regulation for a lift of a valve.

As shown in FIG. 2, the cam 102 rotates with the camshaft 101, the eccentric wheel 113 rotates with the lift regulating shaft 110, and the roller assembly 112 is shared by the cam 102, the eccentric wheel 113 and the intermediate swing arm roller 115, and the roller assembly 112 may have the function of transmitting power and changing the lift of the valve.

Specifically, when the cam 102 rotates, the roller assembly 112 moves along a track of a profile of the cam 102 and transmits the power to the intermediate swing arm roller 115 on the intermediate swing arm 106, such that the intermediate swing arm 106 swings around the intermediate swing arm shaft 114. At this point, the drive profile at the bottom of the intermediate swing arm 106 is in contact with the valve roller 105, thereby moving the valve 103 up and down along the center line of the valve, so as to open or close the air inlet in the cylinder head. The roller assembly 112 reciprocates along the track of the profile of the cam 102, and the valve 103 may be opened or closed periodically. When the eccentric wheel 113 rotates, the intermediate swing arm 106 still swings around the intermediate swing arm shaft 114. At this point, the initial contact position between the valve roller 105 and the drive profile may be changed, thereby achieving an effect of changing the lift of the valve. As such, the roller assembly 112 may transmit the power and change the lift of the valve.

The roller assembly 112 also facilitates reduction of the friction between contacted parts and improvement of mechanism performance, and meanwhile the roller assembly 112 has a simple structure and is convenient to assemble. The spindle 501, the outer ring 502 and the axial limiting portion 503 are all rotation bodies, such that the processing consistency is good, the accuracy is easy to guarantee, and the processing cost is low. In addition, in the process of movement, the roller assembly 112 is closely attached to the cam 102, the eccentric wheel 113 and the intermediate swing arm roller 115, thereby reducing noise pollution effectively.

Specifically, the axial limiting portion 503 is configured as an annular check ring.

Optionally, an average radius of curvature of the second section is 1.5 to 2.5 times a radius of the axial limiting portion.

The engine according to an embodiment of a second aspect of the present application includes the valve mechanism 1000 according to the above-mentioned embodiments.

The vehicle according to an embodiment of a third aspect of the present application includes the engine according to the above-mentioned embodiments.

The above are merely the preferred embodiments of the present application and shall not be used to limit the present application. Any improvements, equivalents and modifications made within the scope and principle of the present application shall fall within the protection scope of the present application.

What is claimed is:

1. A valve mechanism, comprising:

a valve having a valve roller;

a camshaft provided with a cam;

an intermediate swing arm located between the cam and the valve, the cam driving the valve to move by means of the intermediate swing arm, and the intermediate swing arm having an intermediate swing arm roller;

a lift regulating mechanism and a roller assembly, wherein the lift regulating mechanism comprises two eccentric wheels, the roller assembly is supported by the cam, the two eccentric wheels and the intermediate swing arm roller, the lift regulating mechanism is configured to variably regulate a lift of the valve continuously, each eccentric wheel has a rotational axis, a peripheral surface of each eccentric wheel comprises a lift regulating section having a start point and an end point, a maximum lift point of the lift regulating section is located between the start point and the end point, the lift regulating section is divided into a first section from the start point to the maximum lift point and a second section from the maximum lift point to the end point, the first section is configured as a convex arc, at least a part of the second section is an oblique line section, and a distance between any point on the at least a part of the second section and the rotation axis is less than a distance between the maximum lift point and the rotation axis, wherein the roller assembly comprises:

a spindle;

an outer ring, the outer ring being fitted over the spindle, and a plurality of needle rollers surrounding the spindle being provided between the outer ring and the spindle and enabling the outer ring to rotate relative to the spindle; and axial limiting portions located at two axial ends of the outer ring respectively to limit the outer ring axially, and outer diameters of the axial limiting portions being less than an outer diameter of the outer ring, such that the outer ring protrudes out of peripheral surfaces of the axial limiting portions in a radial direction of the spindle, and portions of two axial end surfaces of the outer ring exposed out of the axial limiting portions are configured as axial thrust surfaces, and wherein the roller assembly corresponds to the two eccentric wheels, the two eccentric wheels define a groove therebetween, the outer ring is clamped in the groove, and the axial limiting portions are in sliding fit with the two eccentric wheels.

2. The valve mechanism according to claim 1, wherein the lift regulating section has a wrap angle of 180 to 220 degrees.

3. The valve mechanism according to claim 1, wherein the second section has a difference value between a maximum radius of curvature and a minimum radius of curvature of 0.5 to 2 mm.

4. The valve mechanism according to claim 1, wherein the second section has a difference value between a maximum radius of curvature and a minimum radius of curvature of 0.8 to 1.3 mm.

5. The valve mechanism according to claim 1, wherein the second section has a radius of curvature ranging from 24 to 30 mm.

6. The valve mechanism according to claim 1, wherein an average radius of curvature of the second section is 1.5 to 2.5 times a radius of the axial limiting portion.

7. A vehicle comprising:

an engine comprising:

a valve mechanism comprising:

a valve having a valve roller;

a camshaft provided with a cam;

an intermediate swing arm located between the cam and the valve, the cam driving the valve to move by means of the intermediate swing arm, and the intermediate swing arm having an intermediate swing arm roller;

a lift regulating mechanism and a roller assembly, wherein the lift regulating mechanism comprises two eccentric wheels, the roller assembly is supported by the cam, the two eccentric wheels, and the intermediate swing arm roller, the lift regulating mechanism is configured to variably regulate a lift of the valve continuously, each eccentric wheel has a rotational axis, a peripheral surface of each eccentric wheel comprises a lift regulating section having a start point and an end point, a maximum lift point of the lift regulating section is located between the start point and the end point, the lift regulating section is divided into a first section from the start point to the maximum lift point and a second section from the maximum lift point to the end point, the first section is configured as a convex arc, at least a part of the second section is an oblique line section, and a distance between any point on the at least a part of the second section and the rotation axis is less than a distance between the maximum lift point and the rotation axis, wherein the roller assembly comprises:

a spindle;

an outer ring, the outer ring being fitted over the spindle, and a plurality of needle rollers surrounding the spindle being provided between the outer ring and the spindle and enabling the outer ring to rotate relative to the spindle; and axial limiting portions located at two axial ends of the outer ring respectively to limit the outer ring axially, and outer diameters of the axial limiting portions being less than an outer diameter of the outer ring, such that the outer ring protrudes out of peripheral surfaces of the axial limiting portions in a radial direction of the spindle, and portions of two axial end surfaces of the outer ring exposed out of the axial limiting portions are configured as axial thrust surfaces, and wherein the roller assembly corresponds to the two eccentric wheels, the two eccentric wheels define a groove therebetween, the outer ring is clamped in the groove, and the axial limiting portions are in sliding fit with the two eccentric wheels.

8. An engine comprising:

a valve mechanism comprising:

a valve having a valve roller;

a camshaft provided with a cam;

an intermediate swing arm located between the cam and the valve, the cam driving the valve to move by means of the intermediate swing arm, and the intermediate swing arm having an intermediate swing arm roller;

a lift regulating mechanism and a roller assembly, wherein the lift regulating mechanism comprises two eccentric wheels, the roller assembly is supported by the cam, the two eccentric wheels and the intermediate swing arm roller, the lift regulating mechanism is configured to variably regulate a lift of the valve continuously, each eccentric wheel has a rotational axis, a peripheral surface of each eccentric wheel comprises a lift regulating section having a start point and an end point, a maximum lift point of the lift regulating section is located between the start point and the end point, the lift regulating section is divided into a first section from the start point to the maximum lift point and a second section from the maximum lift point to the end point, the first section is configured as a convex arc, at least a part of the second section is an oblique line section, and a distance between any point on the at least a part of the second section and the rotation axis is less than a distance between the maximum lift point and the rotation axis, wherein the roller assembly comprises:

a spindle;

an outer ring, the outer ring being fitted over the spindle, and a plurality of needle rollers surrounding the spindle being provided between the outer ring and the spindle and enabling the outer ring to rotate relative to the spindle; and axial limiting portions located at two axial ends of the outer ring respectively to limit the outer ring axially, and outer diameters of the axial limiting portions being less than an outer diameter of the outer ring, such that the outer ring protrudes out of peripheral surfaces of the axial limiting portions in a radial direction of the spindle, and portions of two axial end surfaces of the outer ring exposed out of the axial limiting portions are configured as axial thrust surfaces, and wherein the roller assembly corresponds to the two eccentric wheels, the two eccentric wheels define a groove therebetween, the outer ring is clamped in the groove, and the axial limiting portions are in sliding fit with the two eccentric wheels.

9. The engine according to claim 8, wherein the lift regulating section has a wrap angle of 180 to 220 degrees.

10. The engine according to claim 8, wherein the second section has a difference value between a maximum radius of curvature and a minimum radius of curvature of 0.5 to 2 mm.

11. The engine according to claim 8, wherein the second section has a difference value between a maximum radius of curvature and a minimum radius of curvature of 0.8 to 1.3 mm.

12. The engine according to claim 8, wherein the second section has a radius of curvature ranging from 24 to 30 mm.

* * * * *